US009610676B2

(12) United States Patent
Kundracik et al.

(10) Patent No.: US 9,610,676 B2
(45) Date of Patent: Apr. 4, 2017

(54) PIPE WRENCH WITH HOOK SHANK SPACER

(71) Applicant: Emerson Electric Co., St. Louis, MO (US)

(72) Inventors: Richard M. Kundracik, Elyria, OH (US); Jason J. Boggs, South Amherst, OH (US); Glen R. Chartier, Avon Lake, OH (US); Paul W. Gress, Bay Village, OH (US)

(73) Assignee: EMERSON ELECTRIC CO., St. Louis, MO (US)

( * ) Notice: Subject to any disclaimer, the term of this patent is extended or adjusted under 35 U.S.C. 154(b) by 734 days.

(21) Appl. No.: 13/626,132

(22) Filed: Sep. 25, 2012

(65) Prior Publication Data

US 2014/0083260 A1 Mar. 27, 2014

(51) Int. Cl.
*B25B 13/50* (2006.01)

(52) U.S. Cl.
CPC ..... *B25B 13/5041* (2013.01)

(58) Field of Classification Search
CPC ..... B25B 13/16; B25B 13/28; B25B 13/505; B25B 13/5058; B25B 13/12; B25B 7/02
USPC ..... 81/101, 54, 57.33, 57.39, 463, 464, 186
See application file for complete search history.

(56) References Cited

U.S. PATENT DOCUMENTS 911,924 A * 2/1909 Vader ..... B25B 7/04 81/185.1
1,003,060 A 9/1911 Oliver
1,336,754 A * 4/1920 Parmelee ..... 269/150
1,409,811 A * 3/1922 Allen ..... 81/105
2,122,104 A * 6/1938 Compton ..... B25B 7/02 81/399
2,594,684 A * 4/1952 Rothe ..... B25B 7/02 269/274
2,766,649 A * 10/1956 Labry, Jr. ..... B25B 1/2452 269/274
3,188,894 A * 6/1965 Yoshinori Matsuoka ..... 81/101
3,858,467 A 1/1975 Evans
4,380,941 A * 4/1983 Petersen ..... 81/180.1
4,771,661 A * 9/1988 Levchenko et al. ..... 81/57.33
4,903,555 A 2/1990 Howard
4,905,550 A * 3/1990 Albrecht ..... 81/185.1
(Continued)

FOREIGN PATENT DOCUMENTS

CN 2564308 8/2003
CN 101450470 6/2009
(Continued)

OTHER PUBLICATIONS

"Proper Use of Pipe Wrenches," RIDGID, http://www.ridgid.com/ASSETS/49413608655C412F8E7E3BD491795998/ProperUseOfPipeWrenches.pdf.
(Continued)

*Primary Examiner* — Robert Scruggs
(74) *Attorney, Agent, or Firm* — Mark E. Bandy; Rankin, Hill & Clark LLP

(57) ABSTRACT

A shank spacer member and its attachment to a pipe wrench is described. The shank spacer member prevents contact between a pipe or other work piece and a shank portion of a movable jaw when the pipe is positioned in the wrench. Upon application of torque to the wrench, the member and its placement on the wrench provides increased gripping force by the wrench upon the pipe.

5 Claims, 5 Drawing Sheets

(56) References Cited

U.S. PATENT DOCUMENTS

| | | | |
|---|---|---|---|
| 6,202,516 | B1 | 3/2001 | Kim |
| 6,961,973 | B1 | 11/2005 | Smith |
| 7,305,909 | B2 | 12/2007 | Bollinger |

FOREIGN PATENT DOCUMENTS

| | | |
|---|---|---|
| CN | 201632962 | 11/2010 |
| TW | 450159 | 8/2001 |
| TW | 530722 | 5/2003 |

OTHER PUBLICATIONS

International Search Report (ISR) and Written Opinion, PCT/US2013/052220, Dec. 19, 2013 (11 pages).
Chinese Office Action, Application No. 201380042264.7, Aug. 28, 2015 (13 pages).

* cited by examiner

PIPE WRENCH WITH HOOK SHANK SPACER

FIELD

The present subject matter relates to wrenches used for tightening threaded members on a wide array of mechanical components, piping, and conduit such as for example when engaging components and/or providing a sealed connection.

BACKGROUND

Stillson wrenches (commonly known as "pipe wrenches") or other such wrenches utilize a heel jaw secured to a handle and a movable hook jaw which also pivots to a limited extent about a point on the handle. Typically, the hook jaw can be selectively positioned relative to the heel jaw by rotating a threaded member on the wrench. The pivoting action of the hook jaw causes the hook jaw and heel jaw to further close as a rotational force is applied to the handle. Thus, gripping force and torque are simultaneously applied to a work piece.

Pipe wrenches typically used in the field utilize a threaded hook jaw that can be adjusted with a threaded member or nut to fit the size of the work piece. Nonetheless, the placement of the wrench on the work piece may be cumbersome due to the weight of the wrench or variations in the size of the work piece. Thus, it is common for an operator to rest the wrench on a shank portion of the hook jaw before force is applied to the handle. This practice still occurs even though it is known to be an improper use of a wrench as described in a publication, "Proper Use of Pipe Wrenches" by the Ridge Tool Company. FIG. 1 illustrates this common improper placement of a wrench on a work piece. Specifically, a conventional pipe wrench 10 comprises a handle 20 having a lower jaw member 30, a sleeve portion 40 affixed to or integrally formed with the handle 20, a rotatable threaded member 50, and a movable upper jaw 60. The upper jaw 60 includes a proximal end 62, an outer distal end 68, a shank portion 66 extending between the ends 62 and 68, and a threaded region 64. The upper jaw 60 also includes an upper jaw member 70. As will be appreciated, the distance between the lower jaw member 30 and the upper jaw member 70 can be selectively adjusted by rotating the member 50. The upper jaw 60 and specifically the shank portion 66 defines an interior face 67. Upon positioning a work piece 5 between the jaw members 30, 70, typically a user may rest the wrench 10 on the work piece 5, thereby resulting in contact between the shank face 67 and the work piece 5. This practice prevents the pivoting action of the hook jaw and limits the ability of the jaws to produce gripping force. As a result, the wrench may slip on the work piece when torque is applied. Additionally, the mechanical stress in the hook jaw is increased due to a transfer of force from the work piece to the shank of the hook. Failure of the hook jaw may result.

Accordingly, a need exists for a pipe wrench which is not susceptible to such problems with improper use and which provides an increased gripping force on a work piece positioned between its jaws upon application of torque to the wrench.

SUMMARY

The difficulties and drawbacks associated with previously known technology are addressed in the present products and methods as follows.

In one aspect, the present subject matter provides a wrench comprising a handle with a stationary lower jaw portion, and a movable upper jaw having a depending shank. The shank includes a threaded region. The wrench also comprises a sleeve rigidly connected to the handle. The sleeve defines a channel sized to moveably receive at least a portion of the shank of the upper jaw. The wrench also comprises a rotatable member threadedly engaged with the threaded region of the shank of the upper jaw. The member is rotatably secured to at least one of the handle and the sleeve. Upon rotation of the member the distance between the lower jaw and the upper jaw is selectively adjusted. The wrench also comprises a deformable member disposed along at least a portion of a face of the shank of the upper jaw, to thereby preclude contact between the shank and a work piece disposed between the lower jaw and the upper jaw.

In another aspect, the present subject matter provides an adjustable wrench comprising a handle having a lower jaw portion and defining a channel extending through the handle. The wrench also comprises an upper jaw having a transversely extending threaded shank. The shank is movably disposed within the channel. The lower jaw, an inner face of the shank, and the upper jaw collectively define a work piece engaging region. The wrench also comprises a rotatable member threadedly engaged with the threaded shank of the upper jaw and movably retained with the handle. Upon rotation of the member the distance between the lower jaw and the upper jaw is selectively adjusted. And, the wrench also comprises a region of nonmetallic deformable material disposed along the inner face of the shank.

In yet another aspect, the present subject matter provides a wrench comprising a handle with a stationary lower jaw portion. The wrench also comprises a movable upper jaw having a depending shank. The shank includes a threaded region. The wrench also comprises a sleeve rigidly connected to the handle. The sleeve defines a channel sized to moveably receive at least a portion of the shank of the upper jaw. The wrench also comprises a rotatable member threadedly engaged with the threaded region of the shank of the upper jaw. The member is rotatably secured to at least one of the handle and the sleeve. Upon rotation of the member the distance between the lower jaw and the upper jaw is selectively adjusted. The wrench also comprises a spacer member disposed along at least a portion of a face of the shank of the upper jaw and extending from at least one of the handle and the sleeve, to thereby preclude contact between the shank and a work piece disposed between the lower jaw and the upper jaw.

In still another aspect, the present subject matter provides a method of providing an increased gripping force on a work piece positioned between the jaws of a wrench upon application of torque to the wrench. The wrench includes (i) a handle with a stationary lower jaw portion, (ii) a movable upper jaw having a depending shank, the shank including a threaded region, (iii) a sleeve rigidly connected to the handle, the sleeve defining a channel sized to moveably receive at least a portion of the shank of the upper jaw, and (iv) a rotatable member threadedly engaged with the threaded region of the shank of the upper jaw, the member rotatably secured to at least one of the handle and the sleeve. Upon rotation of the member the distance between the lower jaw and the upper jaw is selectively adjusted. The method comprises attaching a spacer member to the wrench to preclude contact between the shank and a work piece disposed between the lower jaw and the upper jaw.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
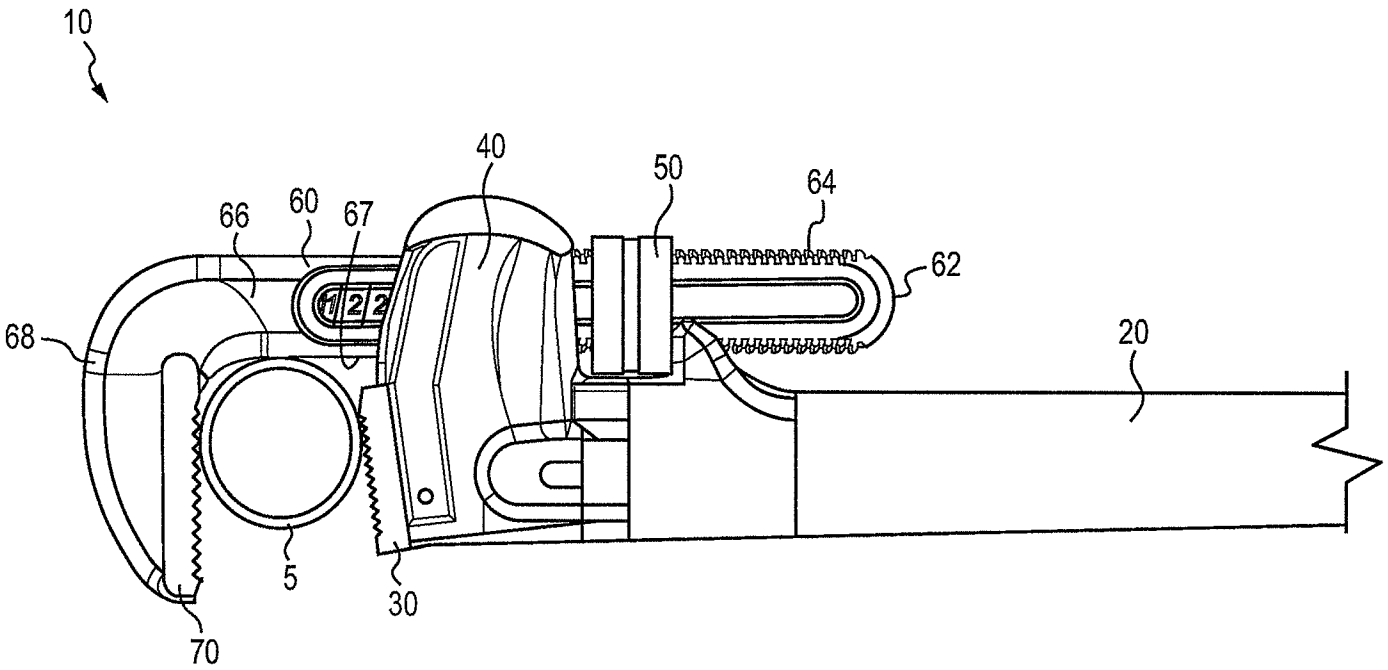
FIG. 1 illustrates a typical yet undesirable placement of a work piece between the jaws of a conventional pipe wrench.

The present subject matter provides a Stillson wrench or pipe wrench having a spacer, bumper, or other member positioned between a shank portion of a hook jaw and a work piece when disposed between the jaws of the wrench. Depending upon the particular configuration, the spacer or member may be formed from a deformable material or a rigid material as described in greater detail herein. The spacer can be disposed either on the hook jaw, handle, or other component depending upon the type of wrench and/or application. With the addition and use of the spacer, the pivoting action of the hook is uninterrupted even if the wrench is rested on the spacer during initial engagement with a work piece. Thus, the problems associated with the previously noted improper field practice, i.e. lack of gripping force and increased mechanical stress, are avoided.

After provision of a pipe wrench having the noted spacer, or after installation of the spacer on a pipe wrench, the spacer is rested on or otherwise contacted with the work piece thereby preventing direct contact between the work piece and the shank of the hook jaw. For embodiments of the present subject matter utilizing spacers formed from deformable materials, as force is applied to the handle, the deformable material of the spacer is compressed between the work piece and the shank of the hook jaw. Thus, the hook jaw pivots towards the heel jaw to produce significantly increased gripping force. Because the modulus of elasticity of the deformable material is much less than that of the material of the hook jaw, a small amount of force is transferred to the shank of the hook jaw as compared to the case in which the shank of the hook contacts the work piece directly. This same material property allows the deformable spacer to withstand large amounts of strain without damage.

The spacer or bumper is positioned on the wrench such that direct contact between the shank portion of the hook jaw and a work piece positioned between the jaws of the wrench, does not occur. The spacer or bumper can be affixed to one or more components of a wrench, or formed or manufactured with such component(s), during manufacturing. Typically, the spacer or bumper is retained along at least a portion of the shank of the hook jaw. Alternatively, the spacer or bumper is secured to a region of the handle or to another component. In this alternate configuration, the spacer or bumper extends to a location relative to the hook jaw such that the spacer prevents contact between a work piece and the previously noted shank region of the hook jaw.

The spacer or bumper can be formed from a ductile or deformable material. Generally, a wide array of materials can be used for the spacer so long as they exhibit a modulus of elasticity or Young's modulus, which is less than that of the material typically forming the hook jaw, e.g. steel or aluminum and the materials can withstand the mechanical strain present in the application without deforming plastically or permanently. For example, in one configuration of a RIDGID model 36 straight wrench produced by the Ridge Tool Company, a relative displacement of 0.032 inches is observed between the shank of the hook and work piece. Thus, a nitrile rubber with a modulus of 0.025-2 MPa is preferred for this particular configuration in order to minimize the stress of the component. In comparison, many steels exhibit a Young's modulus of approximately 200 GPa and many grades of aluminum exhibit a Young's modulus of approximately 70 GPa. Materials can be selected for other configurations using the same approach; however, a Young's Modulus of 5 GPA or less is generally preferred for the deformable version of the spacer. Nonlimiting examples of preferred materials for use in the spacer or bumper of the present subject matter include certain polymeric materials such as nylon; polystyrene; polyesters such as polyethylene terephthalate (PET); polypropylene; polyethylenes including high density (HDPE), medium density, and low density (LDPE); TEFLON materials such as poly(tetra fluoroethylene)(PTFE); rubber; and combinations thereof. For many applications, rubber is preferred. Generally, it is also preferred that the material selected for the spacer or bumper is also elastomeric. The material(s) selected for the spacer or bumper can be foamed and/or include various additives, fillers, and/or other agents. Typically, the deformable material used for the spacer is a non-metal material.

Table 1 set forth below lists several materials which can be used for the deformable spacer or guide. Table 1 also lists various other materials and serves as a guide for the selection of material(s) suitable for the spacer or bumper in accordance with the present subject matter.

TABLE 1

Approximate Young's Modulus for Various Materials

| Material | GPa | lbf/in$^2$ (psi) |
|---|---|---|
| Rubber (small strain) | <0.1 | |
| PTFE (Teflon) | 0.5 | 75,000 |
| Low density polyethylene | 0.238 | 34,000 |
| HDPE | 0.8 | |
| Polypropylene | 1.5-2 | |
| Polyethylene terephthalate (PET) | 2-2.7 | |
| Polystyrene | 3-3.5 | |
| Nylon | 2-4 | 290,000-580,000 |
| Medium-density fiberboard | 4 | 580,000 |
| Pine wood (along grain) | 9 | 1,300,000 |
| Oak wood (along grain) | 11 | |
| High-strength concrete | 30 | |
| Hemp fiber | 35 | |
| Magnesium metal (Mg) | 45 | |
| Aluminum | 69 | 10,000,000 |
| Glass | 50-90 | |
| Aramid | 70.5-112.4 | |
| Mother-of-pearl (nacre, largely calcium carbonate) | 70 | 10,000,000 |
| Tooth enamel (largely calcium phosphate) | 83 | 12,000,000 |
| Brass | 100-125 | |
| Bronze | 96-120 | |
| Titanium (Ti) | | 16,000,000 |
| Titanium alloys | 105-120 | 15,000,000-17,500,000 |

TABLE 1-continued

Approximate Young's Modulus for Various Materials

| Material | GPa | lbf/in$^2$ (psi) |
|---|---|---|
| Copper (Cu) | 117 | 17,000,000 |
| Glass-reinforced plastic (70/30 by weight fiber/matrix, unidirectional, along grain) | 40-45 | 5,800,000-6,500,000 |
| Glass-reinforced polyester matrix | 17.2 | 2,500,000 |
| Carbon fiber reinforced plastic (50/50 fiber/matrix, biaxial fabric) | 30-50 | |
| Carbon fiber reinforced plastic (70/30 fiber/matrix, unidirectional, along grain) | 181 | 26,300,000 |
| Silicon single crystal, different directions | 130-185 | |
| Steel (ASTM-A36) | 200 | 29,000,000 |
| polycrystalline Yttrium iron garnet (YIG) | 193 | 28,000,000 |
| single-crystal Yttrium iron garnet (YIG) | 200 | 30,000,000 |
| Beryllium (Be) | 287 | 42,000,000 |
| Molybdenum (Mo) | 329 | |
| Tungsten (W) | 400-410 | |
| Silicon carbide (SiC) | 450 | |
| Osmium (Os) | 550 | 79,800,000 |
| Tungsten carbide (WC) | 450-650 | |
| Single-walled carbon nanotube | 1,000+ | 145,000,000+ |
| Graphene | 1000 | |

Figure 2:
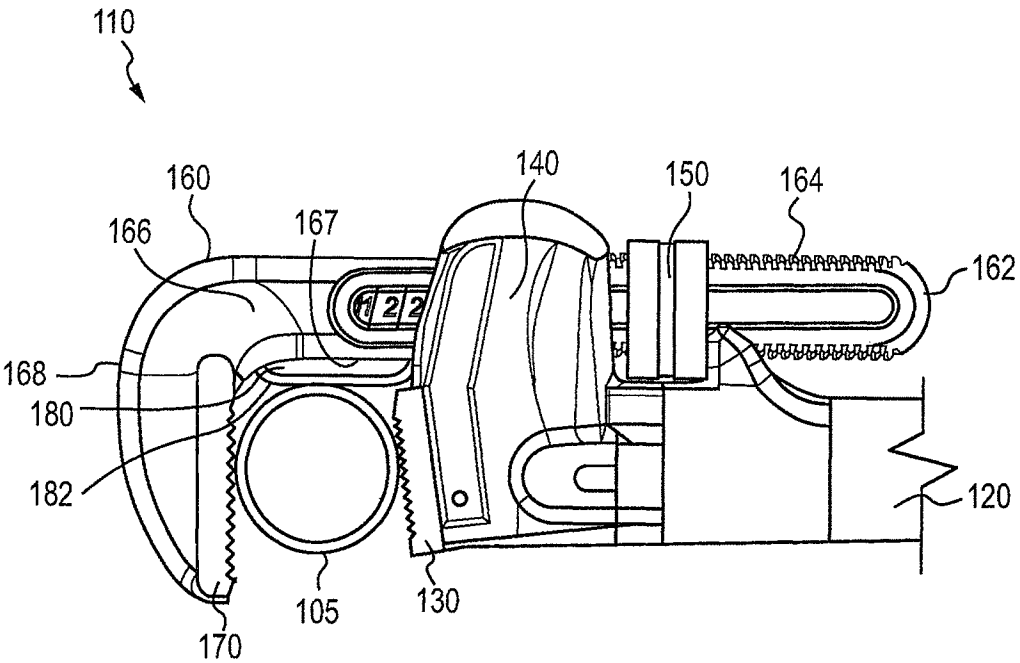
FIG. 2 is a schematic view of a preferred embodiment wrench having a hook shank spacer in accordance with the present subject matter.

FIG. 2 illustrates a version of a preferred embodiment deformable member and a wrench incorporating such member, in accordance with the present subject matter. The wrench 110 comprises a handle 120 having a lower jaw member 130, a sleeve portion 140 affixed or integrally formed with the handle 120, a rotatable threaded member 150, and a movable upper jaw 160. The upper jaw 160 defines a proximal end 162, an outer distal end 168, a shank portion 166 extending between the ends 162 and 168, and a threaded region 164. The upper jaw 160 also includes an upper jaw member 170. The upper jaw 160 and specifically the shank portion 166 defines an interior face 167.

The wrench 110 also comprises a deformable spacer 180 disposed along the interior face 167. Upon positioning a work piece 105 between the jaw members 130, 170, and positioning the work piece 105 toward the shank portion 166, the work piece 105 contacts the deformable spacer 180 instead of the interior face 167 of the shank portion 166. Specifically, the work piece 105 contacts an outer face 182 of the deformable member 180. The deformable member 180 is secured or otherwise attached to the upper jaw 160 and/or the sleeve portion 140 (or other component of the lower jaw 130 or handle 120). The deformable member 180 can be secured or attached by temporary or permanent means. In this particular version, the deformable member 180 is affixed to the interior face 167 of the shank portion 166 of the movable upper jaw 160.

Figure 3:
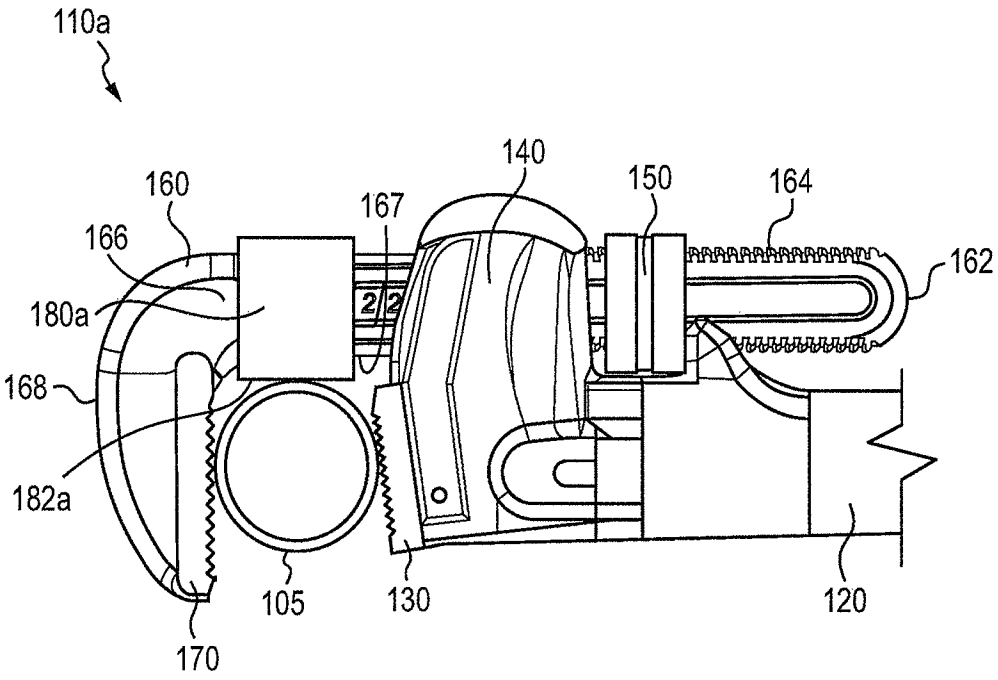
FIG. 3 is a schematic view of another preferred embodiment wrench having an alternate version of the hook shank spacer in accordance with the present subject matter.

FIG. 3 illustrates another version of a wrench 110*a* with a deformable spacer attached thereto. In this version, a deformable spacer 180*a* is positioned about the outer periphery of the upper jaw 160 and specifically about the shank portion 166 to contain the spacer within the assembly. The spacer 180*a* includes an outer surface or region 182*a* that is directed toward or faces a work piece 105 when positioned between the jaw members 130, 170. The wrench 110*a* includes the remaining components having the same reference numbers as the wrench 110 previously described in conjunction with FIG. 2.

Figure 4:
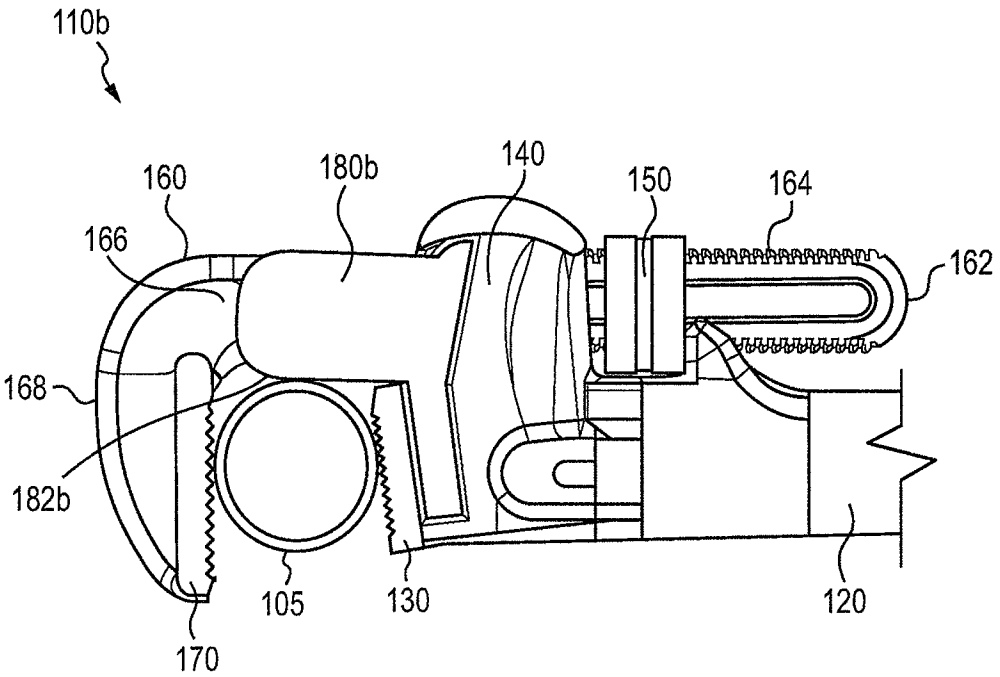
FIGS. 4 and 5 are schematic views of yet another preferred embodiment wrench having another alternate version of the hook shank spacer in accordance with the present subject matter.
Figure 5:
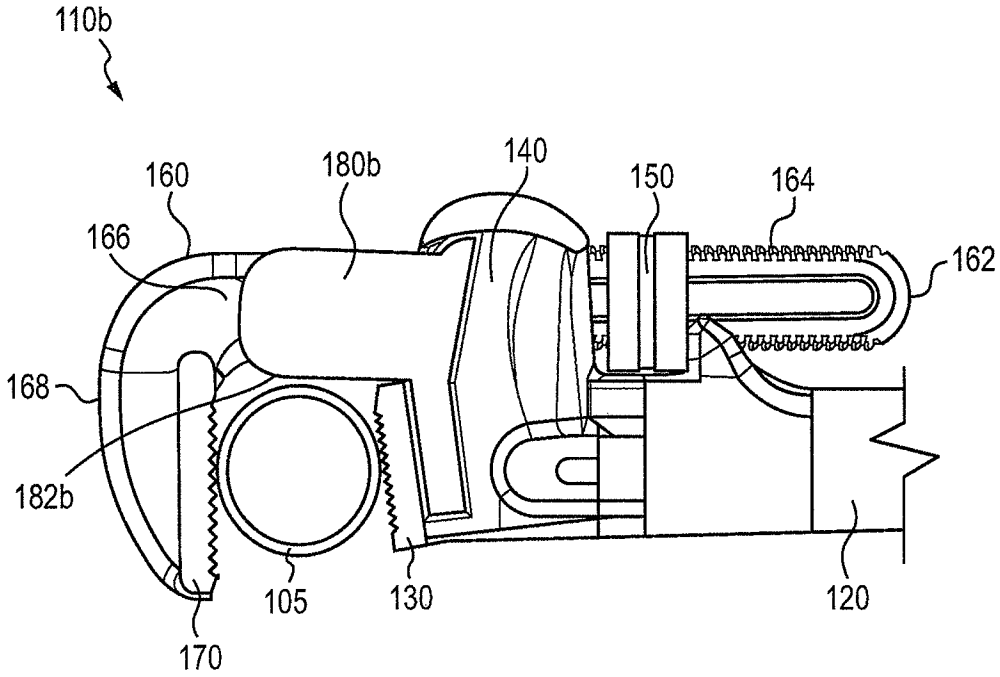

FIGS. 4 and 5 illustrate another version of a wrench 110*b* with a spacer attached thereto. The material for the spacer can be a rigid material. The hook will move closer to the work piece as torque is applied, but the hook will move away from the spacer attached to the handle as shown in FIG. 5. More specifically, in accordance with the present subject matter, a wrench 110*b* having a rigid spacer 180*b* is provided. Upon positioning the wrench 110*b* relative to a work piece 105, the wrench is placed upon and/or rested upon the work piece such that the spacer 180*b* contacts the work piece 105 as shown in FIG. 4. This prevents direct contact between the shank 166 and the work piece 105. FIG. 5 illustrates the wrench 110*b* and work piece 105 after application of a force to the handle 120. The work piece 105 and the upper jaw 160 simultaneously pivot away from the spacer 180*b* and toward the lower jaw 130 to the representative position shown in FIG. 5. Thus, gripping force is applied to the work piece 105. Because the spacer 180*b* is positioned to maintain a gap or space between the shank portion 166 and the work piece 105, no force is transferred between the work piece 105 and the shank portion 166 of the upper jaw as force is applied to the handle 120. In this version, a rigid spacer 180*b* is attached to the sleeve portion 140 or the end of the handle 120 and extends toward the distal end 168 of the movable upper jaw 160. The spacer 180*b* includes an outer surface or region 182*b* that is directed toward or faces a work piece 105 when positioned between the jaw members 130, 170. The spacer 180*b* extends alongside the interior face 167 (see FIG. 2) of the shank portion 166, but is not affixed thereto. This configuration allows the face 167 to be displaced relative to the spacer 180*b* as a user adjusts the distance between the upper and lower jaws. In this version of the present subject matter, the spacer 180*b* is described as formed from a rigid material. However, it will be appreciated that the spacer 180*b* could be formed from a ductile or deformable material also. The term "rigid material" as used herein refers to a material having a Young's modulus of 5 GPa or greater. The wrench 110*b* includes the remaining components having the same reference numbers as the wrench 110 previously described in conjunction with FIG. 2.

The present subject matter also provides methods of providing an increased gripping force on a work piece when positioned between the jaws of a wrench such as a pipe wrench upon application of torque to the wrench. The method comprises attaching a member to the wrench to thereby preclude contact between the shank of the hook jaw and a work piece disposed between the lower jaw and the upper jaw of the wrench. The member can be formed from a deformable material or from a rigid material. As previously described herein, for embodiments in which the member is attached directly to the shank region of an upper jaw such as in FIGS. 2 and 3, the member is typically formed from a deformable member. For embodiments in which the member is attached to a handle, sleeve portion, or other region of a wrench and extends alongside to cover the shank region, the member can be formed from either a deformable material or a rigid material. Attachment of the member can be accomplished in a wide array of techniques and strategies. For example, the member can be formed upon or about selected component(s) of the wrench prior to, during, and/or after assembly of the wrench. The member can also be incorporated within selected components of the wrench such as applied as a coating or layer. The present subject matter includes nearly any means by which the deformable member is attached to the wrench. Attachment of the deformable member can be either permanent or temporary. However, for most applications it is contemplated that a permanent attachment is preferred.

Additional details of components, assembly, and other aspects of pipe wrenches are provided in U.S. Pat. No. 95,744 to Stillson; U.S. Pat. No. 3,320,836 to Hagerman; U.S. Pat. No. 4,144,779 to Honick; U.S. Pat. No. 4,356,743 to Muschalek Jr.; U.S. Pat. No. 7,040,199 to Gregory; and U.S. Pat. No. D657,213 to Pond et al.

The present subject matter can be implemented in a wide range of wrenches and similar tools such as straight pipe wrenches (for example RIDGID® Straight Pipe Wrench model numbers 6 to 60 and aluminum model numbers 810 to 848 available from Ridge Tool), end pipe wrenches (for example RIDGID® End Pipe Wrench model numbers E-6 to E-36 and aluminum model numbers E-910 to E-924), multi-use pipe wrenches (for example RIDGID® Raprench model number 10), offset pipe wrenches (for example RIDGID® Heavy-Duty Offset Pipe Wrench model numbers 14 to 24 and aluminum model numbers 14 to 24), and compound leverage wrenches (for example RIDGID® Compound Leverage Wrenches model numbers S-2 to S-8A).

The present subject matter includes wrenches and similar tools provided with one or more deformable methods as described herein. The present subject matter also includes the deformable members by themselves or provided in a kit form for incorporation on used or previously purchased wrenches or similar tools. The deformable or rigid members can be provided in a wide array of forms, configurations, colors, and so forth and are in no way limited to the particular versions described herein.

Many other benefits will no doubt become apparent from future application and development of this technology.

All patents, applications, and articles noted herein are hereby incorporated by reference in their entirety.

As described hereinabove, the present subject matter overcomes many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A wrench comprising:

a handle with a stationary lower jaw portion;

a movable upper jaw having a depending shank, the shank including a threaded region;

a sleeve rigidly connected to the handle, the sleeve defining a channel sized to moveably receive at least a portion of the shank of the upper jaw;

a rotatable member threadedly engaged with the threaded region of the shank of the upper jaw, the member rotatably secured to at least one of the handle and the sleeve, wherein upon rotation of the member the distance between the lower jaw and the upper jaw is selectively adjusted; and a spacer member disposed along a face of the shank of the upper jaw and extending from the upper jaw to at least one of the handle and the sleeve, to thereby preclude contact between the shank and a work piece disposed between the lower jaw and the upper jaw, wherein a modulus of elasticity of the spacer member is less than a modulus of elasticity of the upper jaw.

2. The wrench of claim 1 wherein the spacer member includes a rigid material.

3. The wrench of claim 1 wherein the spacer includes a deformable material.

4. The wrench of claim 1 wherein the spacer member includes a material selected from the group consisting of nylon, polystyrene, polyester, polypropylene, polyethylene, poly (tetrafluoroethylene), and combinations thereof.

5. The wrench of claim 1 wherein the spacer member extends alongside the face of the shank of the upper jaw but is not affixed thereto.

* * * * *